US005624282A

United States Patent [19]

Eggers et al.

[11] Patent Number: 5,624,282

[45] Date of Patent: Apr. 29, 1997

[54] ELECTRICAL CONNECTOR AND METHOD OF MAKING THE SAME

[75] Inventors: Arthur Eggers, Moore, S.C.; Kevin Henderson, Gastonia, N.C.

[73] Assignee: Thomas & Betts Corporation, Memphis, Tenn.

[21] Appl. No.: 316,184

[22] Filed: Sep. 30, 1994

[51] Int. Cl.[6] ..... H01R 13/40

[52] U.S. Cl. ..... 439/733.1; 439/751

[58] Field of Search ..... 439/733.1, 751, 439/603

[56] References Cited

U.S. PATENT DOCUMENTS

| | | | |
|---|---|---|---|
| 4,035,047 | 7/1977 | Ammon | 439/733.1 OR |
| 5,116,263 | 5/1992 | Bennett et al. | 439/733.1 OR |
| 5,122,075 | 6/1992 | Kile | 439/751 OR |
| 5,238,413 | 8/1993 | McCaffrey et al. | 439/79 |

*Primary Examiner*—P. Austin Bradley

*Assistant Examiner*—Daniels Wittels

*Attorney, Agent, or Firm*—Michael L. Hoelter; Salvatore J. Abbruzzese

[57] ABSTRACT

An electrical connector comprises a housing of electrically insulative material and defining an interior compartment and passages extending from the interior compartment to an exterior surface of the housing. Electrical contact members are resident in the housing passages. At least one of the passages is circular in configuration and a power contact member resident in the one passage has a portion resident in the one passage circular in configuration and in press-fit sealed relation with the housing. The contact member resident in the one passage has a further portion resident in the interior compartment of blade-shaped configuration. A method of making the connector includes a step of press-fitting the power contact member into the one passage from the interior compartment with the contact member circular portion leading the contact member blade portion, such that the circular portion is in interference fit in the one passage and that the blade portion is resident in the interior compartment.

8 Claims, 4 Drawing Sheets

ELECTRICAL CONNECTOR AND METHOD OF MAKING THE SAME

FIELD OF THE INVENTION

This invention relates generally to electrical connectors and pertains more particularly to connectors having both signal and power contact members therein.

BACKGROUND OF THE INVENTION

In typical applications in the electronics industry, electrical connectors need only conduct therethrough relatively low level, i.e., low voltage, signals. Given such signal levels, the sealing relationship between the connector housing and the contact members carrying the signals is not critical.

on the other hand, certain applications in the electronics industry require that both low level signals and power be conducted through the connector. Given that the power voltage level is relatively high, need arises for a high degree of sealing relationship between the power contact member and the connector housing, such that moisture does not have a path along the power contact member into the housing interior.

The power contact member is typically required to be of blade shape interiorly of the connector housing. One known practice for obtaining a high degree of sealing relationship between the power contact member and the connector housing is to mold the housing about the contact members, including the fully blade-shaped power contact member. This practice is relatively costly and complicated as compared to the practice of press-fitting contact members into a pre-existing housing.

Difficulty attends press-fitting of a blade-shaped contact member into a housing and obtaining a high degree of sealing relationship between the contact member and the housing. Assuming there to be a housing contact member receiving passage which is likewise complemental to the blade shape of the contact member, edge warpage attends press-fitting, as does non-uniform hoop stress.

SUMMARY OF THE INVENTION

The present invention has as its primary object the provision of a connector having a press-fit power contact member meeting the requirements of a sealed relation between the contact member and the connector housing and of presenting a blade-shaped contact portion interiorly of the connector housing.

In attaining this and other objects, the invention provides an electrical connector comprising a housing of electrically insulative material and defining an interior compartment and passages extending from the interior compartment to an exterior surface of the housing. Electrical contact members are resident in the housing passages. At least one of the passages is circular in configuration and the contact member resident in the one passage has a portion which is circular in configuration and in press-fit sealed relation with the housing. The contact member resident in the one passage has a further portion resident in the interior compartment which is of blade-shaped configuration.

The method, in accordance with the invention, of making a connector having a power contact in sealed relation therein comprises a first step of preforming a housing of electrically insulative material with an interior compartment and passages extending from the interior compartment to an exterior surface of the housing, at least one of the passages being of circular configuration and of a first diameter. A second step is to form an elongate power contact member of electrically conductive material with a blade-shaped portion at one end thereof and a circular portion longitudinally adjacent the blade-shaped portion, with the circular portion having a diameter exceeding the first diameter. The third step is that of press-fitting the power contact member into the one passage from the interior compartment with the contact member circular portion leading the contact member blade portion, such that the circular portion is in interference fit in the one passage and that the blade portion is resident in the interior compartment.

The foregoing and other objects and features of the invention will be further understood from the following detailed description of preferred embodiments thereof and from the drawings, wherein like reference numerals identify like components throughout.

DESCRIPTION OF THE PREFERRED EMBODIMENT AND PRACTICE

Figure 1:
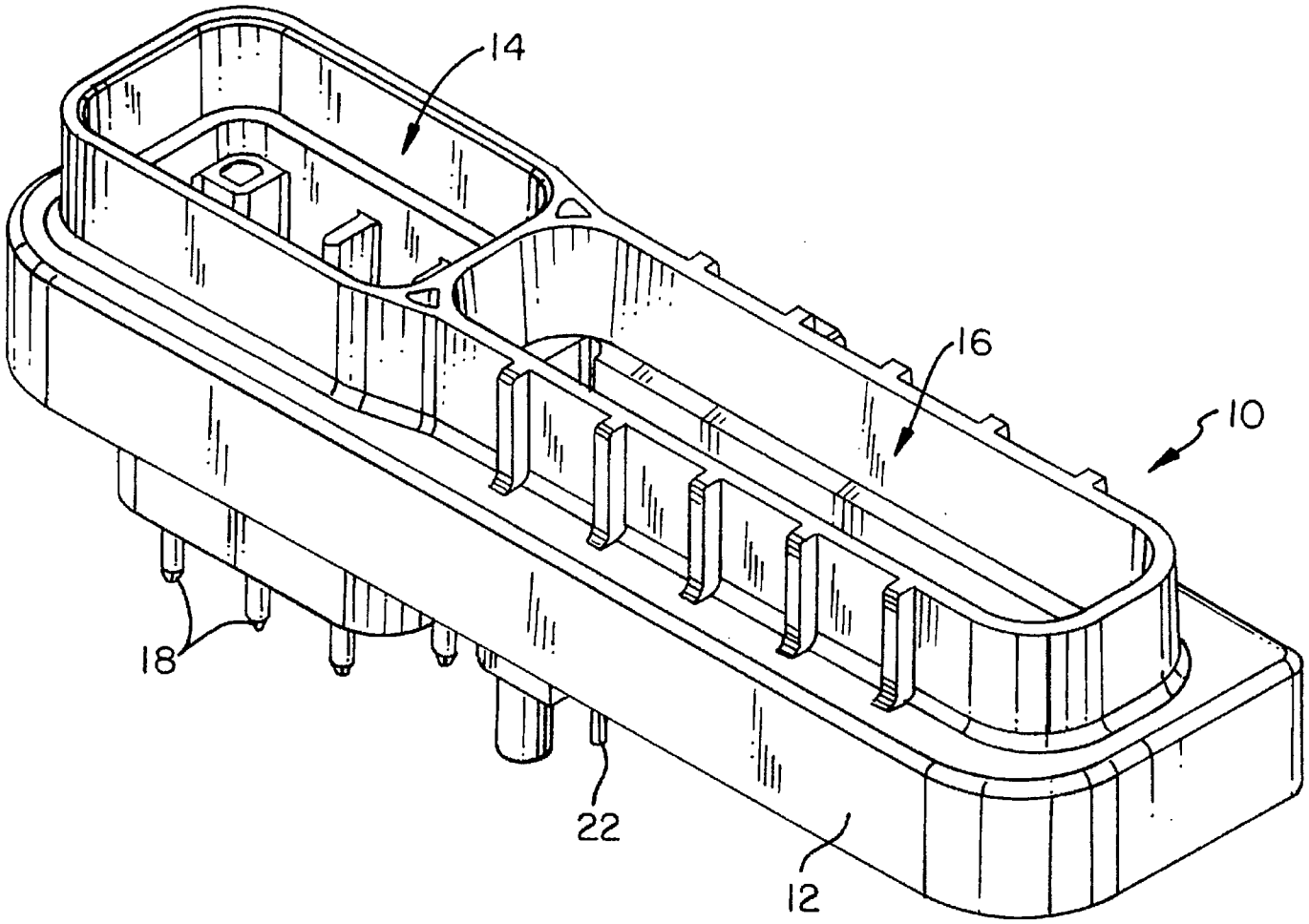
FIG. 1 is a perspective view of a connector in accordance with the invention.
Figure 2:
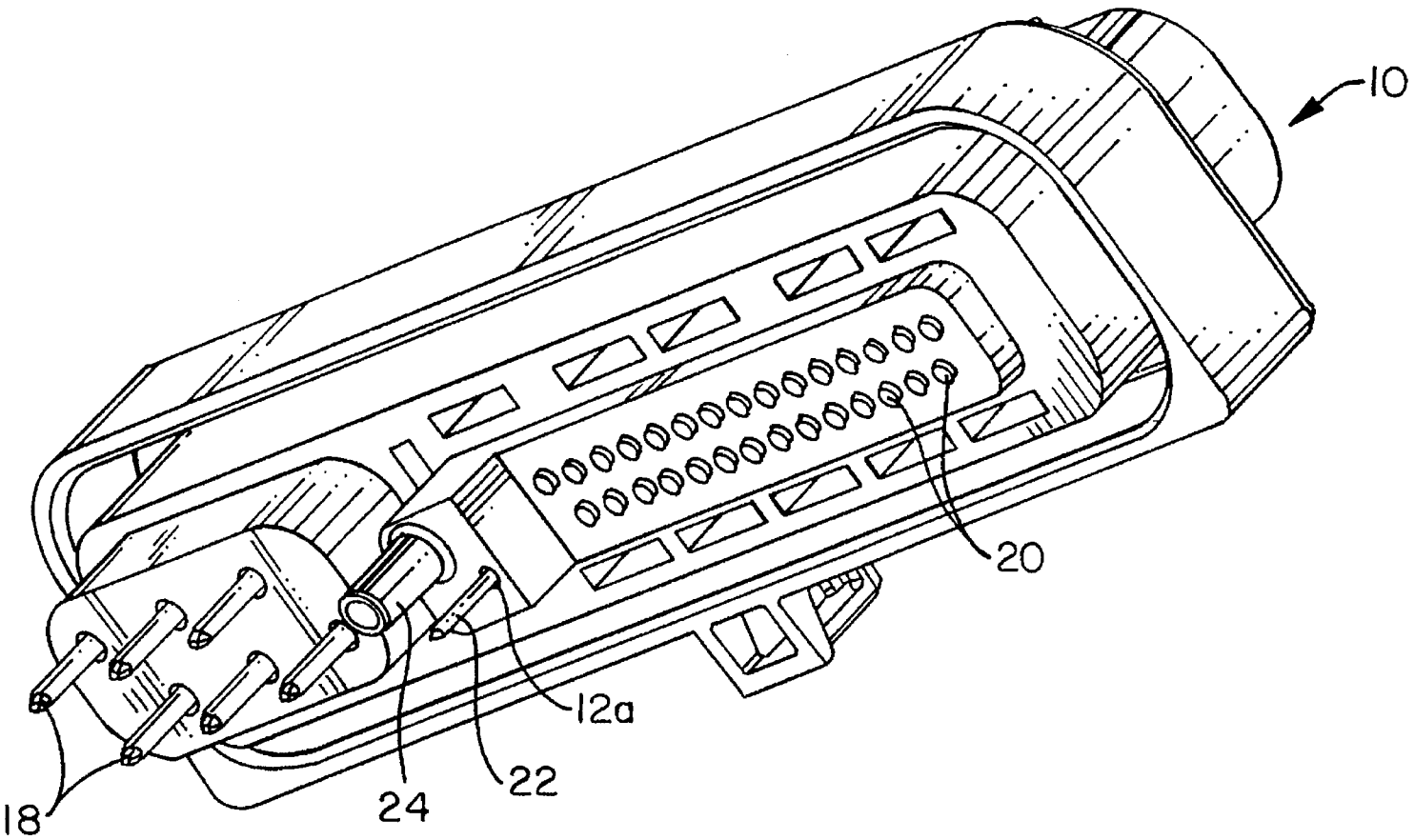
FIG. 2 is a perspective view of the FIG. 1 connector as would be seen from viewing its undersurface.
Figure 3:
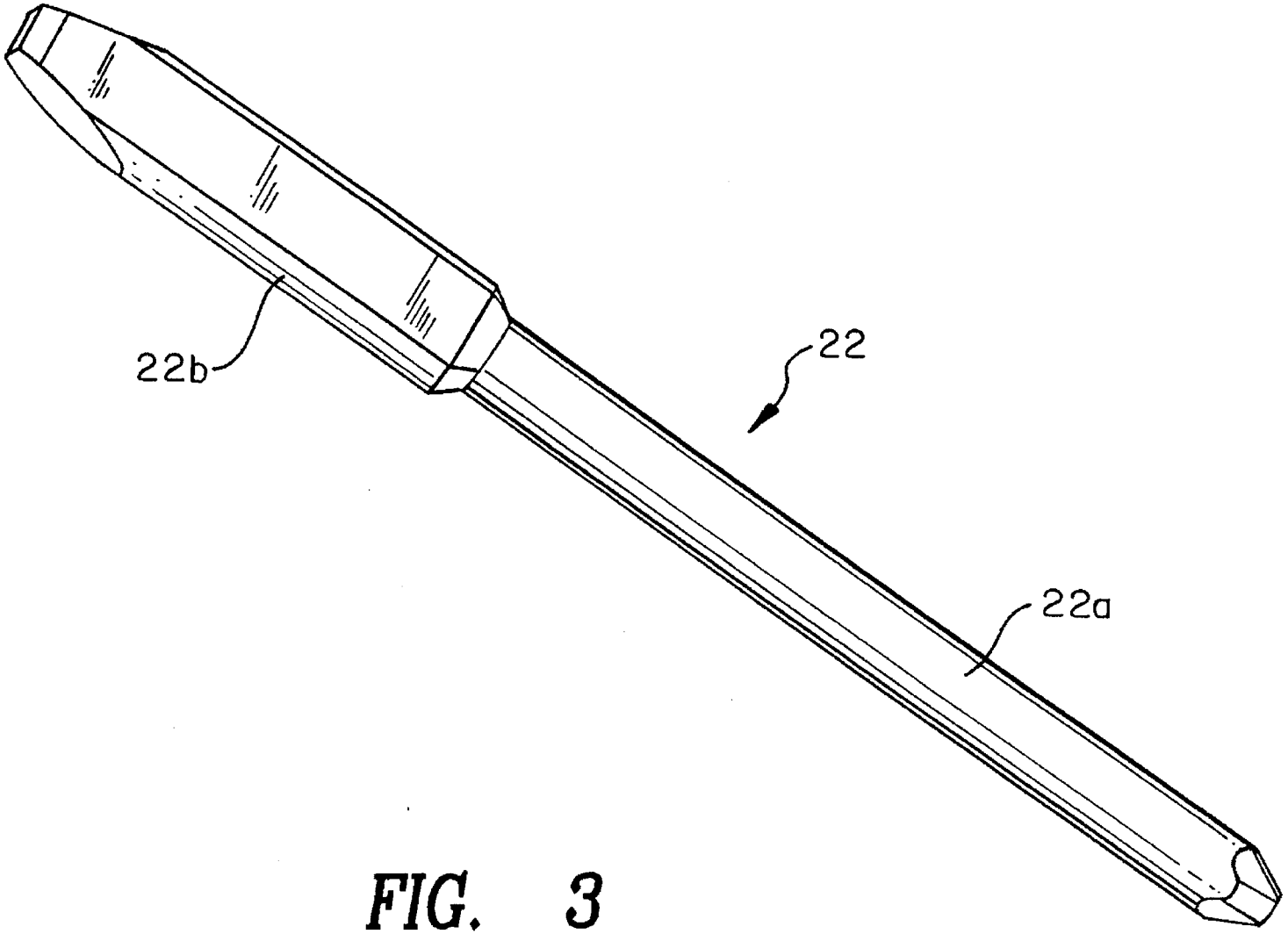
FIG. 3 is a perspective view of the power contact member of the connector of FIGS. 1 and 2.
Figure 4:
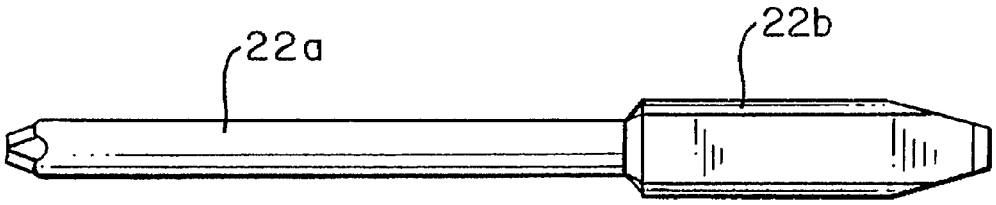
FIG. 4 is a front elevation of the power contact member of the connector of FIGS. 1 and 2.
Figure 5:
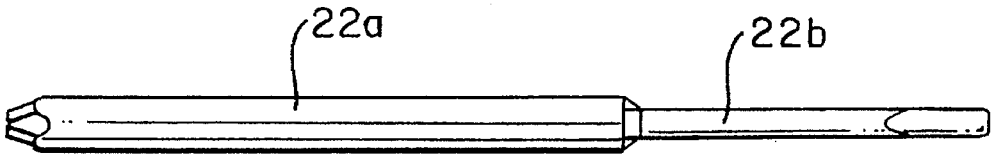
FIG. 5 is a plan view of FIG. 4.
Figure 6:
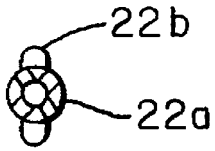
FIG. 6 is a left side elevation of FIG. 4.
Figure 7:
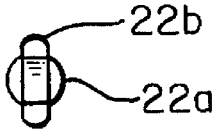
FIG. 7 is a right side elevation of FIG. 4.

Referring to FIGS. 1 and 2, connector 10 has a housing 12 comprised of electrically insulative material. Housing 12 is preformed to define interior compartments 14 and 16 and passages for receipt of press-fit contact members, inclusive of two groups of contact members 18 and 20, and press-fit power contact member 22. All contact members define exterior contact portions, shown in FIG. 2 as accessible at the connector undersurface and contact portions (not shown) in compartments 14 and 16 for mating engagement with contact portions of contact members of a mating connector (not shown). As is seen also in FIG. 2, mounting post 24, formed integrally with housing 12, extends below the connector undersurface and is adapted to seat in a recess of a printed circuit board which has plated through holes (not shown) for receipt of contact members 18, 20 and 22.

Turning to FIGS. 3–7, power contact member 22 has two dissimilarly configured portions, portion 22*a* being cylindrical and portion 22*b* being blade-shaped.

The housing passage 12*a* (FIG. 2) for residence of power contact member 22 is circular and of diameter somewhat less than the diameter of portion 22*a*, whereby upon press-fitting of power contact member portion 22*a* into passage 12*a* from the interior of compartment 16, a round pin, round hole situation is at hand, giving rise to fully uniform hoop stress and a water-tight relation between contact member 22 and housing 12.

Various changes to the particularly disclosed connector may evidently be introduced without departing from the invention. Accordingly, it is to be appreciated that the particularly discussed and depicted preferred embodiment and practice of the invention are intended in an illustrative and not in a limiting sense. The true spirit and scope of the invention are set forth in the ensuing claims.

What is claimed is:

1. An electrical connector comprising a housing of electrically insulative material defining an interior compartment and passages extending from said interior compartment to an exterior surface of said housing, and electrical contact members resident in said housing passages, at least one of said passages being circular in configuration, the contact member resident in said at least one circular passage having a portion being circular in configuration and in press-fit sealed relation with said at least one circular passage in said housing, said contact member resident in said at least one passage having a further portion resident in said interior compartment having a blade-shaped configuration.

2. The connector claimed in claim 1, wherein said contact member resident in said one passage has another portion disposed exteriorly of said housing and having a circular configuration.

3. The connector as claimed in claim 1, wherein the contact member is a power contact for conducting a power voltage therethrough.

4. An electrical connector comprising:

an insulative housing having an interior compartment and at least one circular passage extending from said interior compartment to an exterior surface of said housing, the circular passage having a first diameter; and an elongate contact member formed of electrically conductive material, the contact member including a circular portion having a second diameter, wherein the contact member second diameter is slightly larger than the passage first diameter and further wherein the contact member circular portion is press-fitted into the at least one housing passage, such that the circular portion of the contact member is in sealing, interference fit relationship with the at least one circular passage.

5. The connector claimed in claim 4, wherein the contact member further includes a blade-shaped portion positioned longitudinally adjacent said circular portion, and wherein the blade-shaped portion is resident in said interior compartment when said circular portion of said contact member is fitted within said at least one passage of said housing.

6. The connector claimed in claim 5, wherein the remainder of the contact member which extends from an external surface of the housing is substantially cylindrical in shape.

7. The connector claimed in claim 6, wherein the contact member is a power contact for conducting a power voltage therethrough.

8. The connector claimed in claim 4, wherein the contact member is a power contact for conducting a power voltage therethrough.

* * * * *